United States Patent [19]

Etheridge

[11] 4,321,794

[45] Mar. 30, 1982

[54] GAS TURBINE ENGINE FUEL BURNERS

[75] Inventor: Colin J. Etheridge, Coventry, England

[73] Assignee: Rolls-Royce Limited, London, England

[21] Appl. No.: 129,688

[22] Filed: Mar. 12, 1980

[30] Foreign Application Priority Data

Mar. 20, 1979 [GB] United Kingdom ..... 09839/79

[51] Int. Cl.[3] ..... F02C 7/22

[52] U.S. Cl. ..... 60/743; 60/748; 60/749; 239/432

[58] Field of Search ..... 60/743, 748, 749; 239/432

[56] References Cited

U.S. PATENT DOCUMENTS

| | | | |
|---|---|---|---|
| 3,530,667 | 9/1970 | Bryan | 60/743 |
| 3,724,207 | 4/1973 | Johnson | 60/743 |
| 3,768,250 | 10/1973 | Kawaguchi | 60/748 |
| 3,788,067 | 1/1974 | Carlisle et al. | |
| 3,905,192 | 9/1975 | Pierce et al. | 60/748 |
| 3,912,164 | 10/1975 | Lefebvre et al. | 60/743 |

FOREIGN PATENT DOCUMENTS

| | | |
|---|---|---|
| 805902 | 12/1958 | United Kingdom . |
| 1168593 | 10/1969 | United Kingdom . |
| 1377183 | 12/1974 | United Kingdom . |
| 1377184 | 12/1974 | United Kingdom . |
| 1537671 | 1/1979 | United Kingdom . |
| 1577205 | 10/1980 | United Kingdom . |

*Primary Examiner*—Robert E. Garrett

*Attorney, Agent, or Firm*—Cushman, Darby & Cushman

[57] ABSTRACT

In order to prevent the accumulation of carbon on the pintle of a gas turbine engine fuel burner, the pintle has a hollow base and inlet holes so that a small mass flow of compressor delivery air can enter the hollow base and flow over its interior surface.

4 Claims, 9 Drawing Figures

GAS TURBINE ENGINE FUEL BURNERS

This invention relates to gas turbine engine fuel burners and is particularly concerned with the problem of carbon accretion on parts of such burners, e.g. the central body or pintle which usually extends part way into the engine flame tube. Carbon particles which are produced more readily when the engine is operating at an offdesign point, such as peak power tend to collect on the bluff bases of the burner pintles and gradually a relatively large mass of carbon can become attached to the pintle base. At some point this large carbon mass or parts of it become detached from the pintle and travel through the combustion chamber of the engine and impinge on the downstream components of engine, such as the nozzle guide vanes and the static and rotating blades of the engine turbine, causing erosion of these components or more serious damage.

The present invention seeks to provide a means of preventing the deposition of carbon to any considerable extent. According to the present invention there is provided a gas turbine engine fuel burner having an annular duct arranged to receive a flow of compressed air, means for injecting fuel into said duct, the duct being defined by a wall of the fuel burner and a central body supported in said duct, the central body being hollow and open at its downstream end with respect to the air flow through said duct, a plurality of apertures in the wall of said central body extending between the annular duct and the interior of the central body to enable some of the air flowing through the annular duct to flow over the interior surface of the hollow base of the central body.

Figure 1:
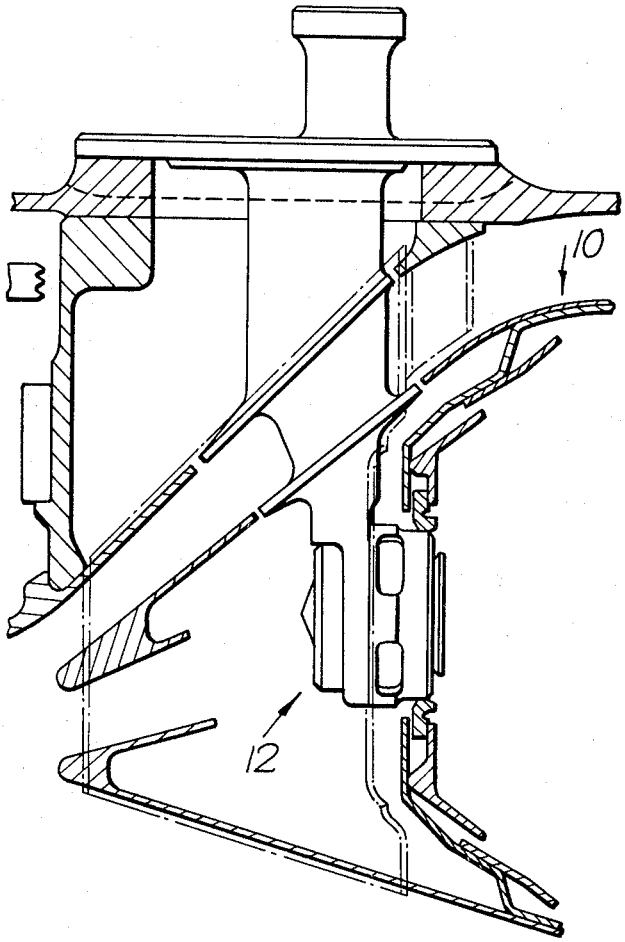
Figure 2:
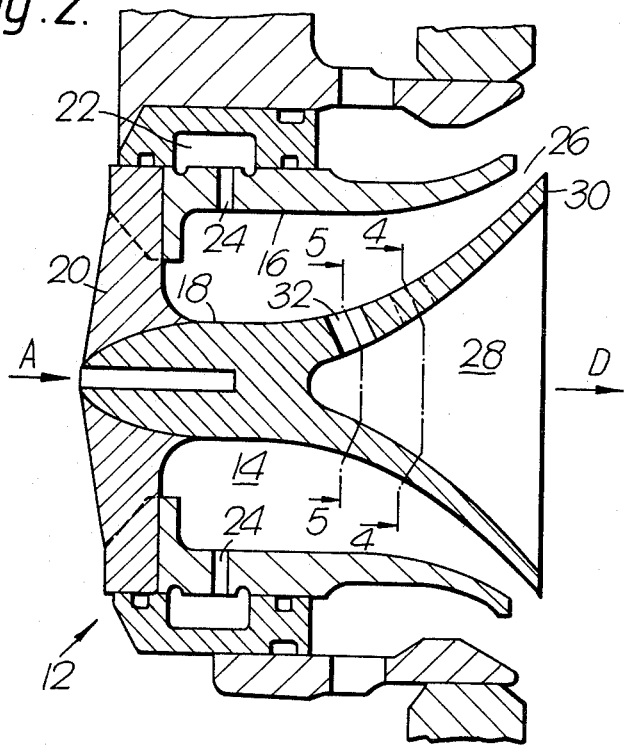
Figure 3:
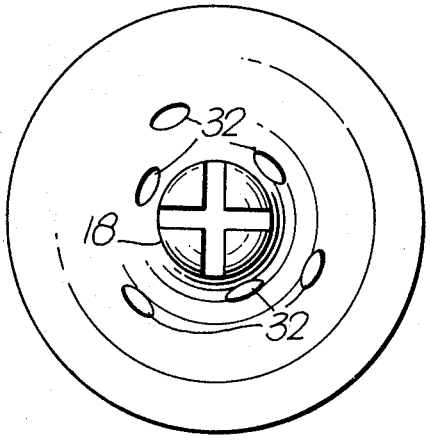
Figure 4:
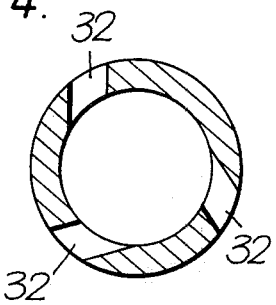
Figure 5:
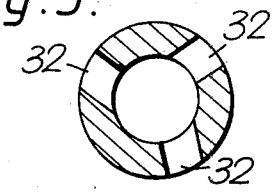
Figure 6:
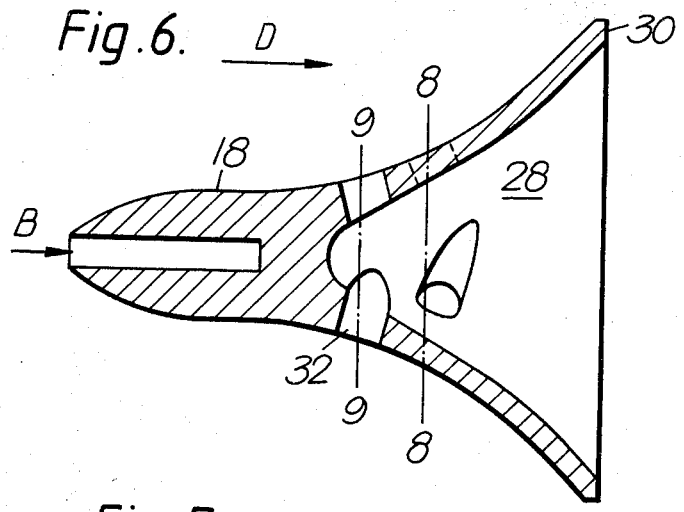
Figure 7:
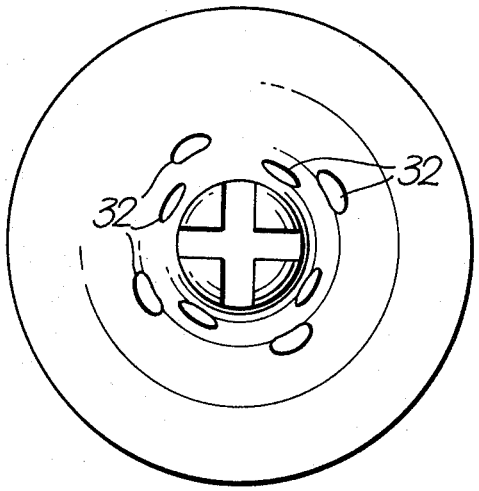
Figure 8:
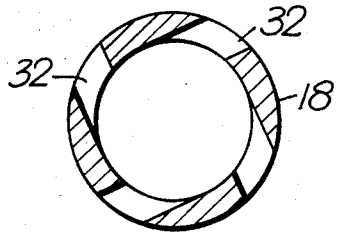
Figure 9:
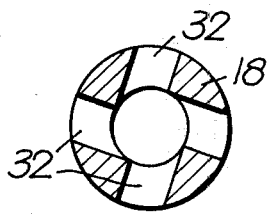

The present invention will now be more particularly described with reference to the accompanying drawings in which;

FIG. 1 shows a portion of the combustion apparatus of a gas turbine engine including one form of fuel burner according to the present invention, FIG. 2 shows a section of the fuel burner and pintle of FIG. 1 to a larger scale, FIG. 3 is a view on arrow 'A' in FIG. 2 disclosing the pintle and with the support bracket omitted for the purpose of clarity, FIG. 4 is a section on line 4—4 in FIG. 2, FIG. 5 is a section on line 5—5 in FIG. 2, FIG. 6 is a modified form of the pintle shown in FIG. 2, FIG. 7 is a view on arrow 'B' in FIG. 6, FIG. 8 is a section on line 8—8 in FIG. 6 and, FIG. 9 is a section on line 9—9 in FIG. 6.

Referring to the Figures and more particularly to FIGS. 1 to 5 inclusive, a gas turbine engine combustion apparatus includes a combustion chamber 10 which in this case is annular, but can be of the can type or the can-annular type, having a number of equi-spaced fuel burners 12 only one being shown.

Each burner 12 has annular duct 14 defined by a wall 16 and a central body or pintle 18 which is support by a cruciform shaped bracket 20 in the annular duct. In use, fuel is injected from a manifold 22 in the fuel burner through inclined apertures 24 so that the fuel swirls around the wall 16 in a downstream direction, following a path similar to a low pitch helix. The air flowing through the duct 14 only has an axial component of direction and the pintle is shaped to provide a venturi with an annular outlet 26, so that the air and fuel are accelerated towards the outlet achieving a maximum shear between the fuel and air, thereby atomising the fuel.

This design results in a pintle which has a bluff downstream base extending partly into the flame tube and any carbon produced in the combustion chamber tends to collect on this base.

The pintle 18, shown more clearly in FIGS. 2 to 5 inclusive has a hollowed out interior 28 leaving only a relatively small annular land 30 as compared to the circular base which previously existed. Two rows of three equi-spaced apertures 32 are formed in the wall of the pintle, the axis of each aperture being tengential to a circle of smaller diameter than the internal diameter of the pintle in the plane containing the axis and inclined in a downstream direction (indicated by arrow D).

FIGS. 6 to 9 show a modification of the pintle shown in the preceding Figures n that each row of apertures contains four apertures 32 the axis of each aperture being arranged as previously described.

In operation, a small proportion of the axially flowing air in the annular duct 14 flows through the apertures 32 into the interior of the pintle and then flows over the interior surface of the pintle preventing carbon from being deposited on that surface.

Since none or hardly any carbon can accumulate on the pintle, the downstream components of the engine will not be subject to erosion from this source and component life is increased.

I claim:

1. A gas turbine engine fuel burner comprising:

an annular wall having an inner surface;

a central body supported coaxially within said annular wall and having an exterior surface spaced from the inner surface of said annular wall to define therewith an annular duct for flow of compressed air axially therethrough over the exterior surface of said central body, said central body flaring outwardly in a downstream direction and defining a hollow downstream end portion with an interior surface having a closed upstream end and an open downstream end;

fuel supply means including a plurality of apertures extending through said annular wall and arranged to cause a downstream flow of fuel in a film on said inner surface of said annular wall; and means including a plurality of apertures extending from said annular duct through said hollow end portion of said central body, said apertures being arranged to bleed a portion of the flow of compressed air from the exterior surface of said central body and direct the same in a downstream direction over the interior surface of said hollow downstream end portion of said central body thereby preventing carbon accumulation on the interior surface of said hollow downstream end portion of said central body.

2. A fuel burner as claimed in claim 1 in which the apertures through said hollow end portion of said central body are arranged in at least two axially spaced rows, there being at least three apertures in each row.

3. A fuel burner as claimed in claim 1 or claim 2 in which each of said apertures through said hollow end portion of said central body has an axis extending tangential to a circle of diameter less than an internal diameter of the interior surface of said hollow end portion of said central body in a plane containing said axis.

4. A fuel burner as claimed in claim 3 in which each said axis is inclined in the downstream direction.

* * * * *

UNITED STATES PATENT AND TRADEMARK OFFICE

CERTIFICATE OF CORRECTION

PATENT NO. : 4,321,794

DATED : March 30, 1982

INVENTOR(S) : Colin J. Etheridge

It is certified that error appears in the above-identified patent and that said Letters Patent is hereby corrected as shown below:

The title page should be deleted to appear as per attached title page.

Signed and Sealed this

*Sixteenth* Day of *November 1982*

[SEAL]

*Attest:*

GERALD J. MOSSINGHOFF

*Attesting Officer*

*Commissioner of Patents and Trademarks*

United States Patent [19]

Etheridge

[11] 4,321,794

[45] Mar. 30, 1982

[54] GAS TURBINE ENGINE FUEL BURNERS

[75] Inventor: Colin J. Etheridge, Coventry, England

[73] Assignee: Rolls-Royce Limited, London, England

[21] Appl. No.: 129,688

[22] Filed: Mar. 12, 1980

[30] Foreign Application Priority Data

Mar. 20, 1979 [GB] United Kingdom ..... 09839/79

[51] Int. Cl.[3] ..... F02C 7/22

[52] U.S. Cl. ..... 60/743; 60/748; 60/749; 239/432

[58] Field of Search ..... 60/743, 748, 749; 239/432

[56] References Cited

U.S. PATENT DOCUMENTS

| | | | |
|---|---|---|---|
| 3,530,667 | 9/1970 | Bryan | 60/743 |
| 3,724,207 | 4/1973 | Johnson | 60/743 |
| 3,768,250 | 10/1973 | Kawaguchi | 60/748 |
| 3,788,067 | 1/1974 | Carlisle et al. | |
| 3,905,192 | 9/1975 | Pierce et al. | 60/748 |
| 3,912,164 | 10/1975 | Lefebvre et al. | 60/743 |

FOREIGN PATENT DOCUMENTS

| | | |
|---|---|---|
| 805902 | 12/1958 | United Kingdom . |
| 1168593 | 10/1969 | United Kingdom . |
| 1377183 | 12/1974 | United Kingdom . |
| 1377184 | 12/1974 | United Kingdom . |
| 1537671 | 1/1979 | United Kingdom . |
| 1577205 | 10/1980 | United Kingdom . |

*Primary Examiner*—Robert E. Garrett

*Attorney, Agent, or Firm*—Cushman, Darby & Cushman

[57] ABSTRACT

In order to prevent the accumulation of carbon on the pintle of a gas turbine engine fuel burner, the pintle has a hollow base and inlet holes so that a small mass flow of compressor delivery air can enter the hollow base and flow over its interior surface.

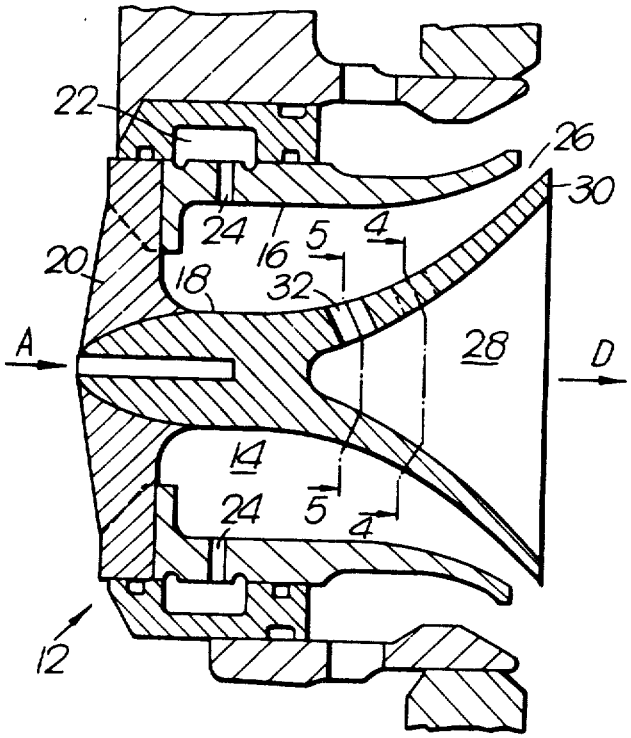

4 Claims, 9 Drawing Figures